US006231379B1

(12) United States Patent
Shen

(10) Patent No.: US 6,231,379 B1
(45) Date of Patent: May 15, 2001

(54) VGA CABLE ADAPTER FOR TRANSMITTING VIDEO SIGNALS

(75) Inventor: Roy Shen, Hsinchu (TW)

(73) Assignee: Innmaging Quality Technology, Inc., Hsinchu (TW)

( * ) Notice: Subject to any disclaimer, the term of this patent is extended or adjusted under 35 U.S.C. 154(b) by 0 days.

(21) Appl. No.: 09/473,119

(22) Filed: Dec. 28, 1999

(51) Int. Cl.[7] ..... H01R 11/00
(52) U.S. Cl. ..... 439/505; 439/623
(58) Field of Search ..... 439/505, 502, 439/623, 503, 504, 624, 498

(56) References Cited

U.S. PATENT DOCUMENTS 5,324,209 * 6/1994 Falossi et al. ..... 439/362
5,605,473 * 2/1997 Kishon ..... 439/502
6,007,372 * 12/1999 Wood ..... 439/502
6,106,328 * 8/2000 O'Neal ..... 439/503

* cited by examiner

*Primary Examiner*—Gary F. Paumen
*Assistant Examiner*—Ross Gushi
(74) *Attorney, Agent, or Firm*—Sughrue, Mion, Zinn, Macpeak & Seas, PLLC

(57) ABSTRACT

A Video Graphics Array (VGA) adapter for transmitting video signals. Make use of three spare pins of a VGA connector to define three video signal-transferring channels as Y, Pb and Pr for devising two VGA adapters. One of the two adapters is to provide connecting between a VGA interface and an RCA terminal and the other VGA interface. The other one is to provide connecting between a VGA interface and an S-terminal and an integrated video signal terminal and the other VGA interface.

16 Claims, 4 Drawing Sheets

VGA CABLE ADAPTER FOR TRANSMITTING VIDEO SIGNALS

FIELD OF THE INVENTION

The present invention relates to an electrical connector, and more particularly, to a cable adapter for transferring video signals.

BACKGROUND OF THE INVENTION

Nowadays, a variety of input and output devices for video signals transferring are widely used in personal computers (PCs), projectors, video recorders, and laser compact disc players, etc. The video information of a PC is transferring to a display (i.e. a monitor) by means of an interface. The interface can be a monochrome display adapter (MDA), a color graphic adapter (CGA), a video graphic array (VGA), or a more advanced super VGA (SVGA).

VGA is in widely use among all kinds of video adapter in that it has a high level of compatibility. A generic VGA has fifteen pins, and each pin has a definition except for three spare pins. For example, the fourth pin is defined as for transferring blue color signals, the ninth pin is defined as for transferring red color signals, and the fourteenth pin is defined as for transferring vertical sync signals. Therefore, it needs only twelve pins for transferring video information from a PC to a monitor.

A video player (or a laser compact disc player) as one kind of video output devices transfers video signals to a video receiver, e.g. television, through an RCA terminal. The RCA terminal can be used to transfer red, green, and blue color signals, but the chromaticity signals and the brightness signals are coupled altogether. In this case, the video quality will be influenced due to the coupled signals. There is a built-in output connector, however, in some video outputting devices, which can separate the chromaticity signals from the brightness signals, thus provides a higher quality of the output picture of a video device. Conventionally, it is called the "S-terminal". Referring to FIG. 1, it is a schematic diagram of a conventional S-terminal. It can be seen that the S-terminal 10 shown in FIG. 1 has four pins, the third pin 12 is used to relay chromaticity signals (the so-called "Y signal"), and the fourth pin 14 is used to relay brightness signals (the so-called "C signal"). The first pin and the second pin are reserved as grounding.

Therefore, the video signals that output from a PC or the alike are to be processed via different interfaces, and different cable connectors must be connected to different adapters. It will be more convenient to have an integrated adapter that can serve to connect related devices while using PC peripherals and other video output devices simultaneously. For example, it is possible for a projection TV to connect to a PC and a video player (or the alike) at the same time by using an integrated adapter. It's not only a convenience, but also providing a way to save space. So it is desirable to have such an integrated adapter.

SUMMARY OF THE INVENTION

The video signals that output from a PC (or the alike) are to be processed via different interfaces, and different cable connectors must be connected to different adapters for video outputs of non-PC peripherals. The object of the invention is to utilize three spare pins of a standard VGA connector to define three video signal-transferring channels as Y, Pb and Pr for devising two VGA adapters. Therefore, it is intended to integrate the cable adapters for PCs and non-PC peripheral devices.

The VGA cable adapter according to the present invention can provide the connection between two PC's VGA interfaces, and it can further provide a non-PC peripheral device to be connected simultaneously, such that the connection is simple and easy to use.

DETAILED DESCRIPTION OF THE PREFERRED EMBODIMENT

Figure 1:
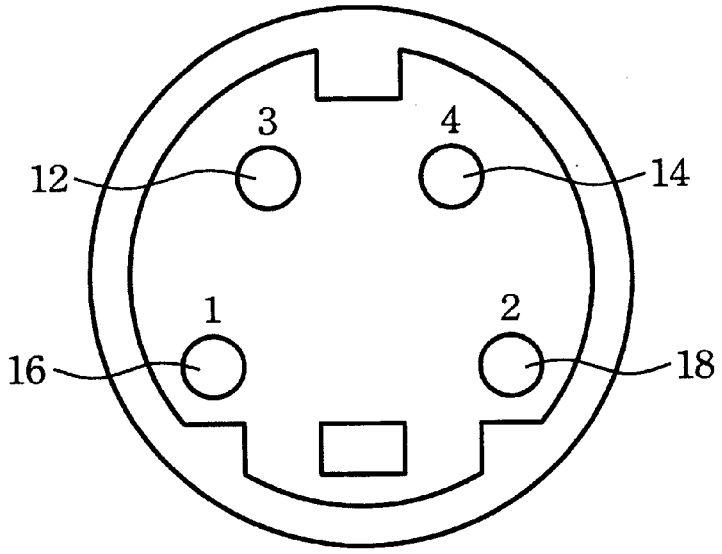
Fig.1 PRIOR ART
FIG. 1 is a schematic diagram of a conventional S-terminal.
Figure 2:
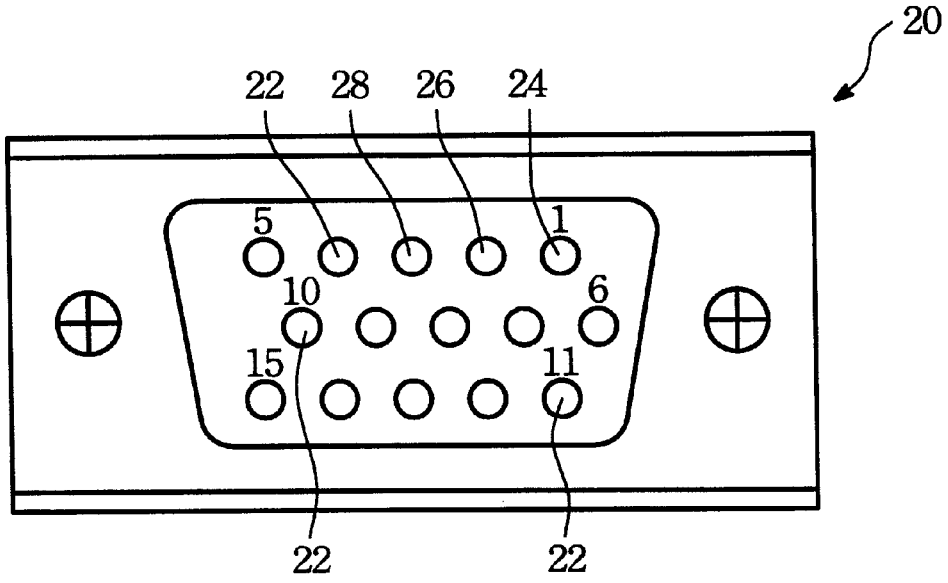
Fig.2 PRIOR ART
FIG. 2 is a schematic diagram depicting the arrangement of pins of a conventional D-sub female VGA adapter.

Referring to FIG. 2, it is a schematic diagram depicting the arrangement of pins of a conventional D-sub female VGA adapter. It shows that there are 15 pins on the standard VGA adapter 20. Each pin has its own definition except for three pins 22 (the fourth, the ninth, and the eleventh pins are assumed for the following description, but it is not limited in this assumption). In terms of the prior art, for example, the first pin 24 is used for transferring red color signals, the second pin 26 is used for transferring green color signals, and the third pin 28 is used for transferring blue color signals, etc.

Figure 3:
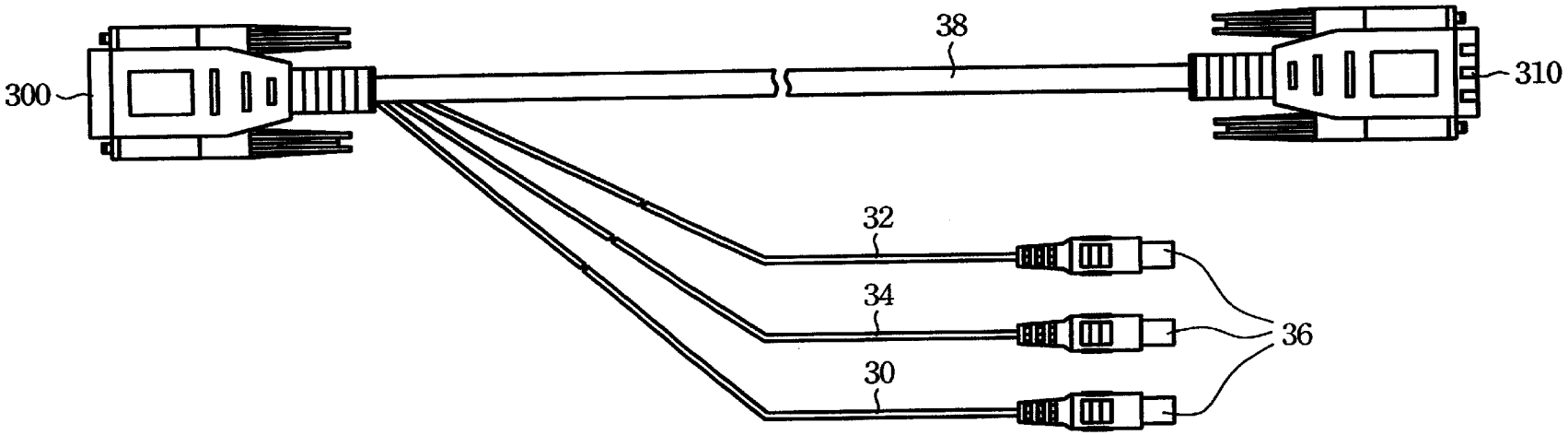
FIG. 3 is a schematic structural view of a VGA cable adapter according to a first embodiment of the invention, which provides connecting to an RCA terminal.

Referring to FIG. 3, it is a schematic structural view of a VGA cable adapter according to a first embodiment of the invention, which provides connecting to an RCA terminal. The three spare pins of a female VGA adapter 300 are led out to form three leading wires: a Y wire 30, a Pb wire 32, and a Pr wire 34, and the three wires are connected respectively to RCA female terminals 36 for further connecting to a RCA terminal. The corresponding relations between the three wires and the RCA terminal are as following: the Y wire is corresponding to green color signals, the Pb wire is corresponding to blue color signals, and the Pr wire is corresponding to red color signals. And the left twelve pins are connecting to a male terminal 310 of the other VGA adapter through a cable 38. This is a first embodiment of the present invention.

Figure 4:
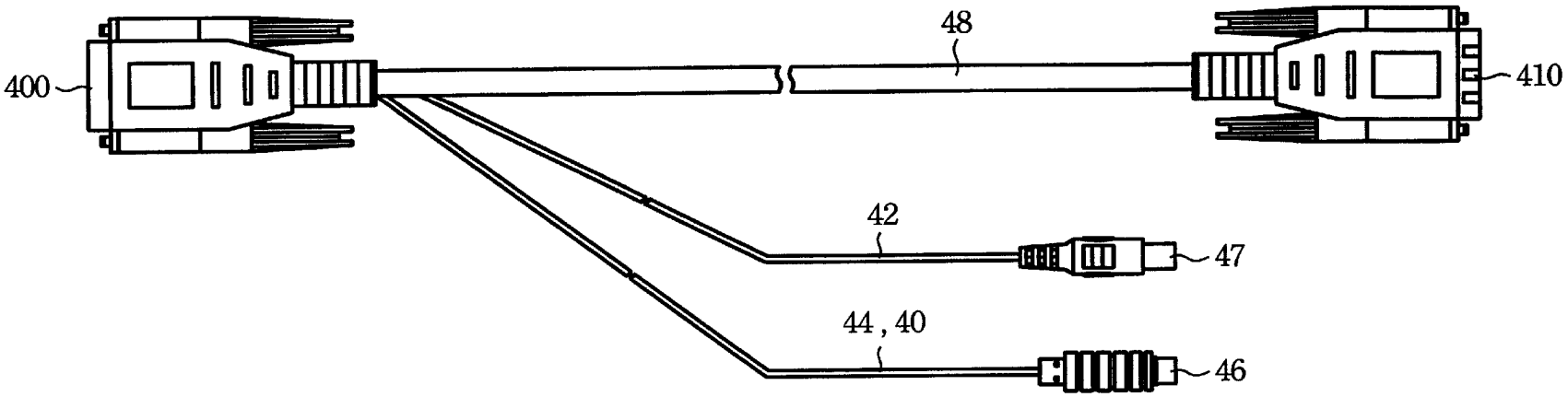
FIG. 4 is a schematic structural view of the VGA cable adapter according to a second embodiment of the invention, which provides connecting to an S-terminal and an integrated video signal terminal.

Referring to FIG. 4, it is a schematic structural view of the VGA cable adapter according to a second embodiment of the invention, which provides connecting to an S-terminal and an integrated video signal terminal. The three spare pins of a female VGA adapter 400 are led out to form three leading wires: a Y wire 40, a Pb wire 42, and a Pr wire 44. The Y wire 40 is connected with the brightness signals of an S-terminal 46 for transferring brightness video signals. The Pr wire 44 is connected with the chromaticity signals of the S-terminal 46 for transferring chromaticity video signals, and the Pb wire 42, on the other hand, is for transferring an integrated video signals with a RCA female adapter 47. Note that the Y wire 40 and the Pr wire 44 are in the same cable. And the left twelve pins are connecting to a male terminal 410 of the other VGA adapter through a cable 48. This is a second embodiment of the present invention.

Figure 5A:
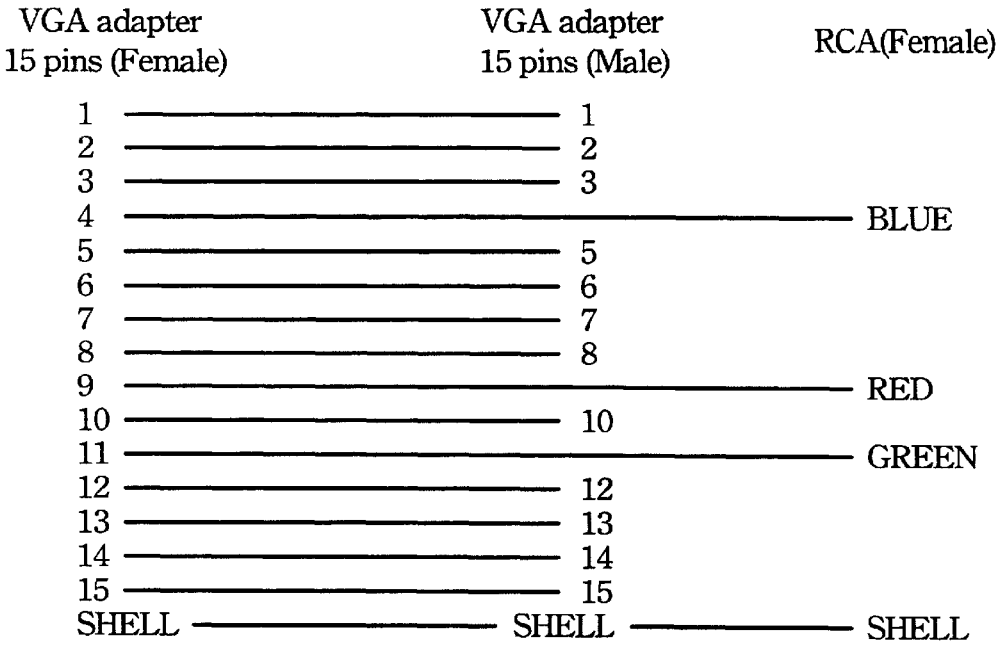
FIG. 5A depicts the corresponding relationships among the pins of the VGA female adapter, the VGA male adapter and the RCA female adapter.
Figure 5B:
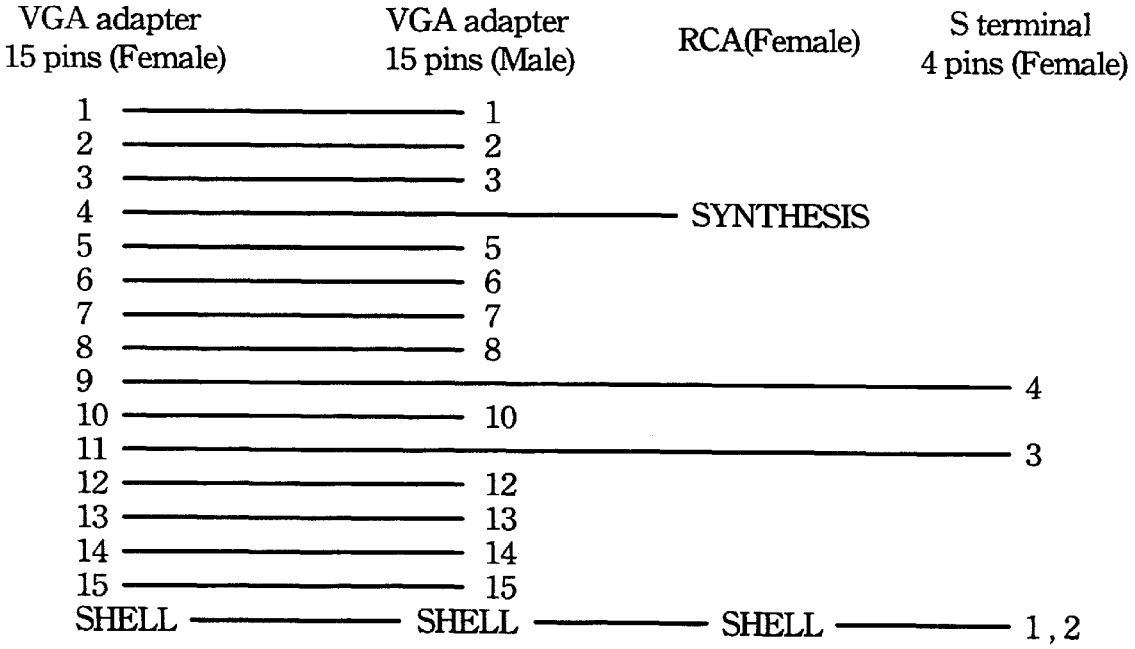
FIG. 5B depicts the corresponding relationships among the pins of the VGA female adapter, the VGA male adapter and the female adapter of the S terminal.

The corresponding relationships of the pins of related adapters are depicted in FIG. 5A and FIG. 5B. Note that the first and the second pins of the S terminal are for grounding.

As is understood by a person skilled in the art, the foregoing preferred embodiments of the present invention that are illustrated of the present invention rather than limiting of the present invention. It is intended to cover various modifications and similar arrangements included within the spirit and scope of the appended claims, the scope of which should be accorded the broadest interpretation so as to encompass all such modifications and similar structure.

What is claimed is:

1. A video signals transferring cable, comprising:

a first Video Graphics Array (VGA) adapter, having a plurality of pins for connecting a plurality of wires;

a second VGA adapter, having a plurality of pins, and said plurality of pins are connected with said plurality of pins of said first VGA adapter except for a first pin, a second pin and a third pin;

a first wire, having a first end and a second end, said first end of said first wire being connected with said first pin of said first VGA adapter, and said second end of said first wire being connected with a first pin of a female terminal;

a second wire, having a first end and a second end, said first end of said second wire being connected with said second pin of said first VGA adapter, and said second end of said second wire being connected with a second pin of a female terminal;

a third wire, having a first end and a second end, said first end of said third wire being connected with said third pin of said first VGA adapter, and said second end of said third wire being connected with a third pin of a female terminal; and a cable for connecting said first VGA adapter with said second VGA adapter.

2. The video signals transferring cable according to claim 1, wherein said first VGA adapter is a female terminal.

3. The video signals transferring cable according to claim 1, wherein said second VGA adapter is a male terminal.

4. The video signals transferring cable according to claim 1, wherein said first wire is used to transfer green color video signals.

5. The video signals transferring cable according to claim 1, wherein said second wire is used to transfer blue color video signals.

6. The video signals transferring cable according to claim 1, wherein said third wire is used to transfer red color video signals.

7. The video signals transferring cable according to claim 1, wherein the pin number of said female terminal is different from the pin number of said first VGA adapter.

8. The video signals transferring cable according to claim 1, wherein the pin number of said female terminal is different from the pin number of said second VGA adapter.

9. A video signals transferring cable, comprising:

a first VGA adapter, having a plurality of pins for connecting a plurality of wires;

a second VGA adapter, having a plurality of pins, and said plurality of pins are connected with said first VGA adapter except for a first pin, a second pin and a third pin of said first VGA adapter;

a first wire, having a first end and a second end, said first end of said first wire being connected with said first pin of said first VGA adapter, and said second end of said first wire being connected with a first pin of a S-terminal with 4 pins;

a second wire, having a first end and a second end, said first end of said second wire being connected with said second pin of said first VGA adapter, and said second end of said second wire being connected with a second pin of said S-terminal;

a third wire, having a first end and a second end, said first end of said third wire being connected with said third pin of said first VGA adapter, and said second end of said third wire being connected with a female terminal; and a cable for connecting said first VGA adapter with said second VGA adapter.

10. The video signals transferring cable according to claim 9, wherein said first VGA adapter is a female terminal.

11. The video signals transferring cable according to claim 9, wherein said second VGA adapter is a male terminal.

12. The video signals transferring cable according to claim 9, wherein said first wire is used to transfer brightness signals.

13. The video signals transferring cable according to claim 9, wherein said second wire is used to transfer chromaticity signals.

14. The video signals transferring cable according to claim 9, wherein said third wire is used to transfer integrated video signals.

15. The video signals transferring cable according to claim 9, wherein said first pin of said S-terminal is used to relay chromaticity signals, said second pin of said S-terminal is used to relay brightness signals, and the other pins of said S-terminal are reserved as grounding.

16. The video signals transferring cable according to claim 9, wherein said first pin of said S-terminal is used to relay brightness signals, said second pin of said S-terminal is used to relay chromaticity signals, and the other pins of said S-terminal are reserved as grounding.

* * * * *